US006081280A

United States Patent [19]

Bolash et al.

[11] Patent Number: 6,081,280

[45] **Date of Patent: *Jun. 27, 2000**

[54] METHOD AND APPARATUS FOR INHIBITING ELECTRICALLY INDUCED INK BUILD-UP ON FLEXIBLE, INTEGRATED CIRCUIT CONNECTING LEADS, FOR THERMAL INK JET PRINTER HEADS

[75] Inventors: John Philip Bolash; Thomas Jon Eade; Mark Joseph Edwards; Bruce David Gibson, all of Lexington, Ky.

[73] Assignee: Lexmark International, Inc., Lexington, Ky.

[ * ] Notice: This patent issued on a continued prosecution application filed under 37 CFR 1.53(d), and is subject to the twenty year patent term provisions of 35 U.S.C. 154(a)(2).

[21] Appl. No.: 08/682,812

[22] Filed: Jul. 11, 1996

[51] Int. Cl.[7] ..... B41J 2/05

[52] U.S. Cl. ..... 347/9; 347/5

[58] Field of Search ..... 347/5, 9, 15, 19, 347/77, 81, 76, 86

[56] References Cited

U.S. PATENT DOCUMENTS

| | | | |
|---|---|---|---|
| 3,798,656 | 3/1974 | Lowy et al. | 347/77 |
| 4,035,812 | 7/1977 | Van Breemen et al. | 347/76 |
| 4,119,973 | 10/1978 | Stager | 347/77 |
| 4,286,274 | 8/1981 | Shell et al. | 347/90 |
| 4,422,084 | 12/1983 | Saito | 347/7 |
| 4,752,782 | 6/1988 | Saito et al. | 347/55 |
| 4,929,963 | 5/1990 | Balazar | 347/89 |
| 4,933,684 | 6/1990 | Tasaki et al. | 347/17 |
| 4,994,821 | 2/1991 | Fagerquist | 347/81 |
| 5,164,747 | 11/1992 | Osada et al. | 347/19 |
| 5,357,081 | 10/1994 | Bohorquez | 219/497 |
| 5,363,134 | 11/1994 | Barbehenn et al. | 347/5 |
| 5,371,530 | 12/1994 | Hawkins et al. | 347/9 |
| 5,467,119 | 11/1995 | Richtsmeier et al. | 347/102 |
| 5,479,199 | 12/1995 | Moore et al. | 347/102 |
| 5,500,667 | 3/1996 | Schwiebert et al. | 347/102 |
| 5,504,511 | 4/1996 | Nakajima et al. | 347/86 |
| 5,610,635 | 3/1997 | Murray et al. | 347/7 |

*Primary Examiner*—N. Le
*Assistant Examiner*—Anh T. N. Vo
*Attorney, Agent, or Firm*—John J. McArdle

[57] ABSTRACT

Method and apparatus for inhibiting electrically induced ink build-up on flexible, integrated circuit connecting leads, for thermal ink jet printer heads is disclosed, and relates to a thermal ink jet printer having a print head comprising an integrated circuit chip, a nozzle plate including a plurality of ink ejecting nozzles therein and overlying a heater resistor for each of the nozzles. Each of the associated heater resistors has associated active circuitry on the chip. On the chip there are a plurality of auxiliary functions requiring power, for example a substrate (silicon chip) heater, a shift register containing print head identification, fault detection circuit connections, etc. The machine includes a power supply and printer control logic, and gate means responsive to the logic upon sending a control signal to effect operation of at least one of the auxiliary functions to energize the function by gating the power supply to the integrated circuit chip and the associated auxiliary function only for a duration corresponding to necessary energization of the function. Because electrically induced ink build-up (EIIBU) usually occurs only between adjacent lands or traces of the TAB or flexible printed circuit that have voltage differentials, functions associated with those lands or traces are the functions which are gated to power from the power supply.

9 Claims, 7 Drawing Sheets

METHOD AND APPARATUS FOR INHIBITING ELECTRICALLY INDUCED INK BUILD-UP ON FLEXIBLE, INTEGRATED CIRCUIT CONNECTING LEADS, FOR THERMAL INK JET PRINTER HEADS

FIELD OF THE INVENTION

The present invention relates to a thermal ink jet recording apparatus employed for recording information in the form of visual images and symbolic characters by means of thermally effecting the ejection of ink droplets onto an ink receiving/recording media (e.g. sheets of paper and the like). More particularly, the present invention relates to a method and apparatus for preventing electrically induced ink build-up between circuits on the Tape Automated Bonding (TAB bond) flexible circuit on a thermal ink jet print head or other flexible printer circuits that make up the inter-connection system. This ink build up is promoted by the presence of DC voltage differentials on the circuits themselves. Ink that bridges circuits can create short circuits and other like malfunctions.

DESCRIPTION OF RELATED ART

Ink jet recording apparatus have several well known advantages. For example, the noise level generated by printing/recording is so low as to be negligible and ordinary sheets of paper may be employed without processing and/or coating special synthetic materials on the surfaces thereof. There exist various kinds of ink jet ejecting methods used in the ink jet recording apparatus and in recent years, some of these methods have been put into practical uses.

Among the various kinds of ink jet ejecting methods, one ink jet ejecting method that has proved not only viable, but reliable and relatively inexpensive is an ink jet ejecting method which employs kinetic energy for ejecting ink droplets by transferring thermal energy into the ink. In this method a rapid volumetric change occurs in the ink because of liquid to vapor transition of the ink caused by the thermal energy so that an ink droplet is ejected from an ejection outlet formed at the front of a recording head, thereby creating an ink droplet. The ink receiving or recording medium is placed close to the nozzle, and the ejected droplet reaches the surface of the recording medium thus establishing information recording.

A recording or printhead used in the above described ink ejecting method, in general, has the ink ejection outlet for ejecting ink droplets and an ink liquid passage which communicates with the ink ejection outlet which includes an electro-thermal converting element for generating the thermal energy. The electro-thermal converting element includes a resistance layer for heating by applying a voltage between two electrodes in the material. In this kind of a printhead, forces are applied into the ink in the ink liquid passage, which are induced by capillary action, pressure drops or the like, and are balanced so that a meniscus is formed in the liquid passage adjacent the ink ejection outlet. Every time an ink droplet is ejected, by means of the above mentioned balanced forces applied to the ink, ink is drawn into the ink passage and a meniscus is formed again in the ink passage adjacent the ink ejection outlet.

There are numerous difficulties that may occur with an ink jet system such as that heretofore described. For example, the active nozzle heater driver circuit, including the heater, for applying thermal energy to the ink, is almost always located on an integrated circuit chip (as opposed to discrete components).

Conventionally the interconnection between the chip and the external world is through a TAB flexible circuit or tape that connects the data line to the heater chip pads and another pad to ground. The tape or TAB circuitry is coated to inhibit ink that happens to spread under the TAB circuit, from shorting lines on the circuit. Occasionally this coating may be flawed and may include voids. Under these circumstances, ink deposited in a manner to underlie (partially) a TAB circuit, tends to migrate or grow over time between circuits on the TAB circuit at different potentials. While the phenomenon may be likened to "Plating", suffice at this time that it shall be referred to hereinafter as "EIIBU" or electrically induced ink build-up. This phenomenon appears to occur because the ink is ionic, and the potential difference tends to be attractive to the ink. No matter what it is called, once an ink bridge occurs, a short circuit condition exists and line driver or control circuit destruction is likely to occur. Additionally, a flexible printed circuit that connects the TAB circuit on the print head with the printer control electronics, is uncoated around the TAB-Flexible-Printed-Circuit mating area. Ink in this area, while less likely because of greater distance from the heater chip, will cause the same problem. The problem is compounded in printer's having long life and high usage.

SUMMARY OF THE INVENTION

In view of the above, it is a principal object of the present invention to inhibit the short circuits that may occur due to electrically induced ink build-up (EIIBU) between TAB bond pad circuitry, or connections through flexible circuitry attached thereto, on a thermal ink jet print head when there is some leakage of ink into a flaw occurring between the pads, the beam leads of the TAB circuit connecting the pads, the tape lands and even the flexible printed circuit connecting the print head to the machine electronics and power supply.

Another object of the present invention is to prevent moderate impedance short circuits on any driven lines of a thermal ink jet printhead caused by EIIBU action that can occur due to ink leakage and bridging between elements external to the IC chip on the printhead and the machine electronics, to prevent damage to the external line printer drivers.

Defined herein is a method of and apparatus for inhibiting EIIBU of ink between adjacent lands of a TAB circuit (and elsewhere between the printhead and the machine printer control electronics) connecting ink jet printhead integrated circuits by limiting the application of differential voltages to those adjacent pads (on the IC) and lands of the interconnecting flexible circuit to only those times when a particular function is called for by the printer control electronics.

Because EIIBU is caused by DC voltage differentials between adjacent printhead input/ output lines, which may, over a period of time effect a short circuit between the input/output, causing the printhead to malfunction, it is preferable, in accordance with the invention, to provide means for application of power (dc voltages) to several of these functions only when the desired function is in operation as opposed to maintaining the DC bias on the printhead at all times that the machine is powered on. Thus EIIBU is inhibited in two ways: (1) by limiting the duration of applicable power to the chip only for the period of time necessary for accomplishing the function, and (2) by gating the power to those pads on the chip in which adjacent pads would exhibit a potential difference (voltage) which in the event of ink between lands of the flexible circuit, would result in bridging, and shorts.

Other objects and a more complete understanding of the invention may be had by referring to the following description taken in conjunction with the accompanying drawings in which:

BRIEF DESCRIPTION OF THE DRAWINGS

FIG. 1D is an enlarged view of a frontal view (not to scale) of the nozzle plate, the chip, connecting flexible tape and the like;

FIG. 1D is an enlarged nozzle plate portion, view in plan of fragmenting portion shown in FIG. 1C and illustrating the nozzle plate, the chip and flexible tape;

DESCRIPTION OF THE ILLUSTRATIVE EMBODIMENTS

Figure 1A:
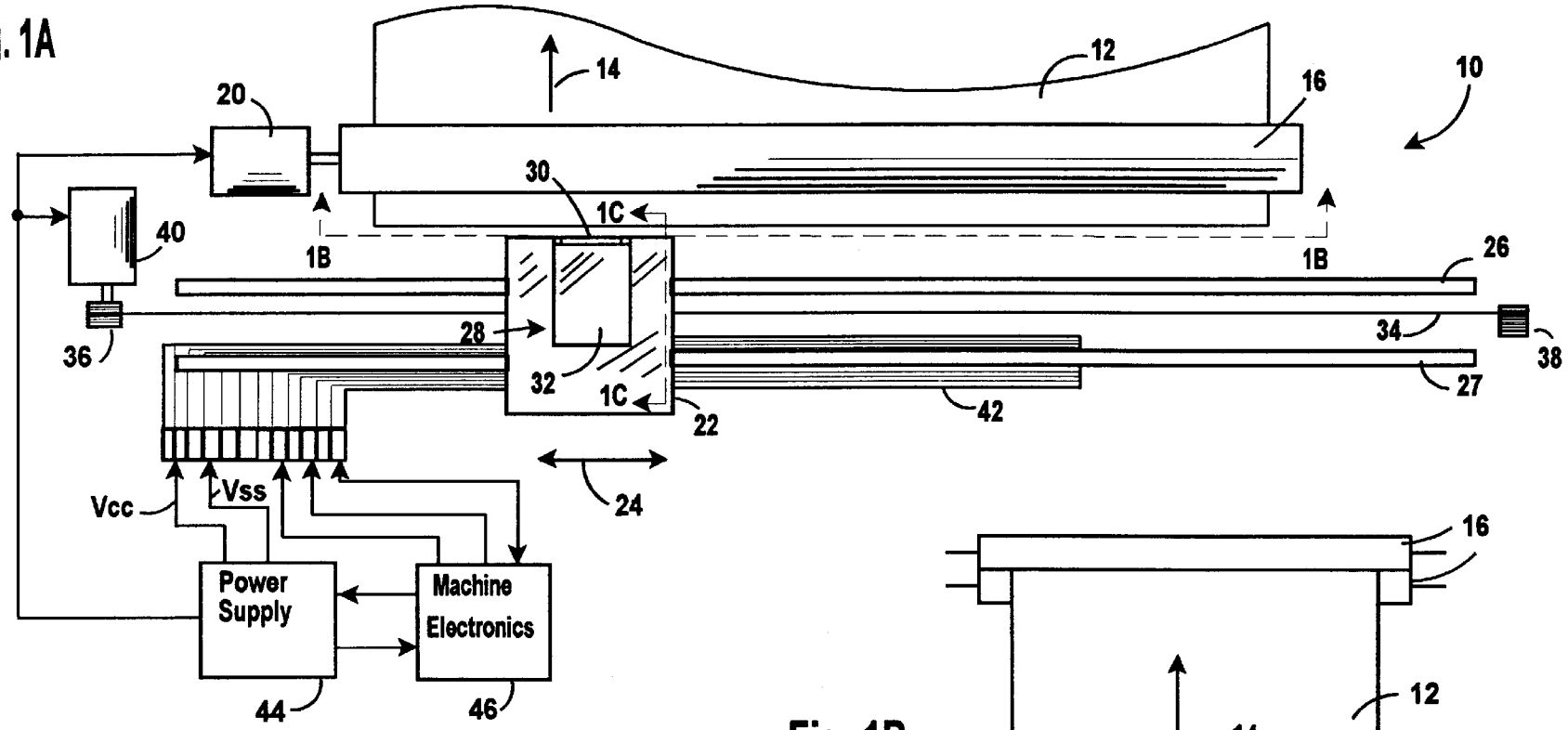
FIG. 1A is a schematic view in plan of a thermal ink jet printer to which the novel method and apparatus of the present invention pertains.

Turning now to the drawings, and particularly FIG. 1A, illustrated therein is an embodiment of an ink jet printer 10 to which the present invention is applicable. In FIG. 1A, a print receiving media 12, which is a recording medium made from paper or plastic thin film and the like, is moved in the direction of an arrow 14, being guided by superimposed pairs 16, 18 of sheet feed rollers and under control of medium drive means, in the present instance a drive motor 20.

Figure 1B:
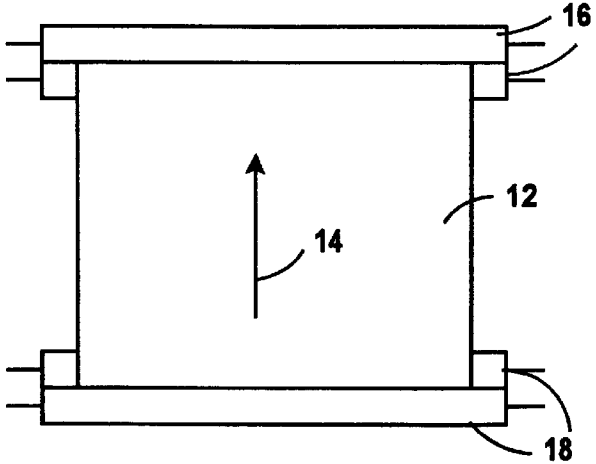
FIG. 1B is a fragmentary, reduced view of a portion of the apparatus illustrated in FIG. 1A, and taken along line 1B—1B of FIG. 1A.
Figure 1C:
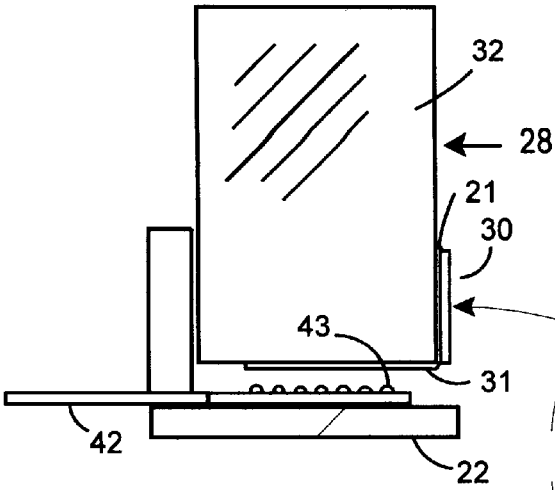
FIG. 1C is an enlarged, fragmentary sectional view of a portion of the apparatus shown in FIG. 1A, taken along line 1C—1C of FIG. 1A.
Figure 1D:
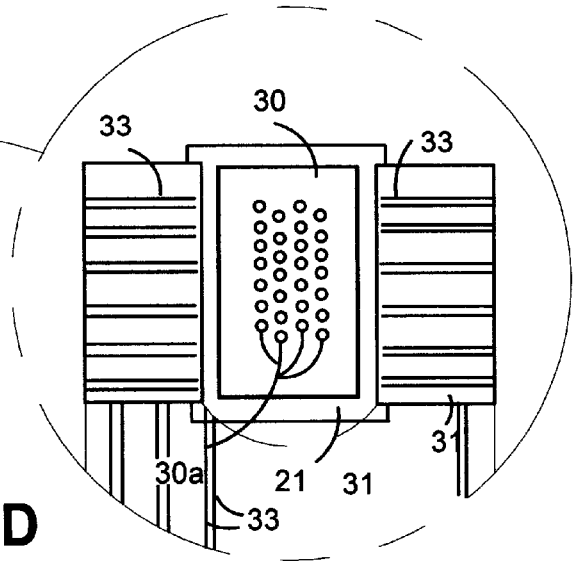

As shown best in FIG. 1B, roller pairs 16, 18 are spaced apart a sufficient distance to permit passage therebetween of a printhead carrier 22, in close proximity to the print receiving media 12 which extends intermediate the roller pairs 16, 18. As shown in FIG. 1A by the arrow 24, the carrier 22 is mounted for orthogonal, reciprocatory motion relative to the print receiving media 12. To this end, the carrier 22 is mounted for reciprocation along a pair of guide shafts 26, 27. Mounted on the carrier 22 is a recording head unit comprising, in the present instance, an insertable ink jet printhead 28 including a plurality of individually selectable and actuable nozzles 30*a* (see FIG. 1D) in a nozzle plate portion 30, and a supply of ink in an ink holding tank or bottle 32. With this structure the ink ejection nozzles 30*a* in the nozzle plate 30 of the ink jet printhead 28 confront the print receiving media 12, and ink may be ejected, in the manner heretofore described, by thermally heating the ink in the nozzles, to effect printing on the print receiving media 12. It should be noted that the nozzles 30*a* shown in the FIG. 1D are not to scale and while a plurality are shown, the number is only for example.

The reciprocatory or side-to-side motion of the carrier 22 is established by carrier drive means, in the illustrated instance comprising a transmission mechanism including a belt 34 and pulleys 36, 38 moving the belt 34 under control of a carrier drive motor 40. In this manner, the print head 28 may be moved and positioned at designated positions along a path defined by and under control of the carrier drive means and machine electronics 46.

Figure 7:
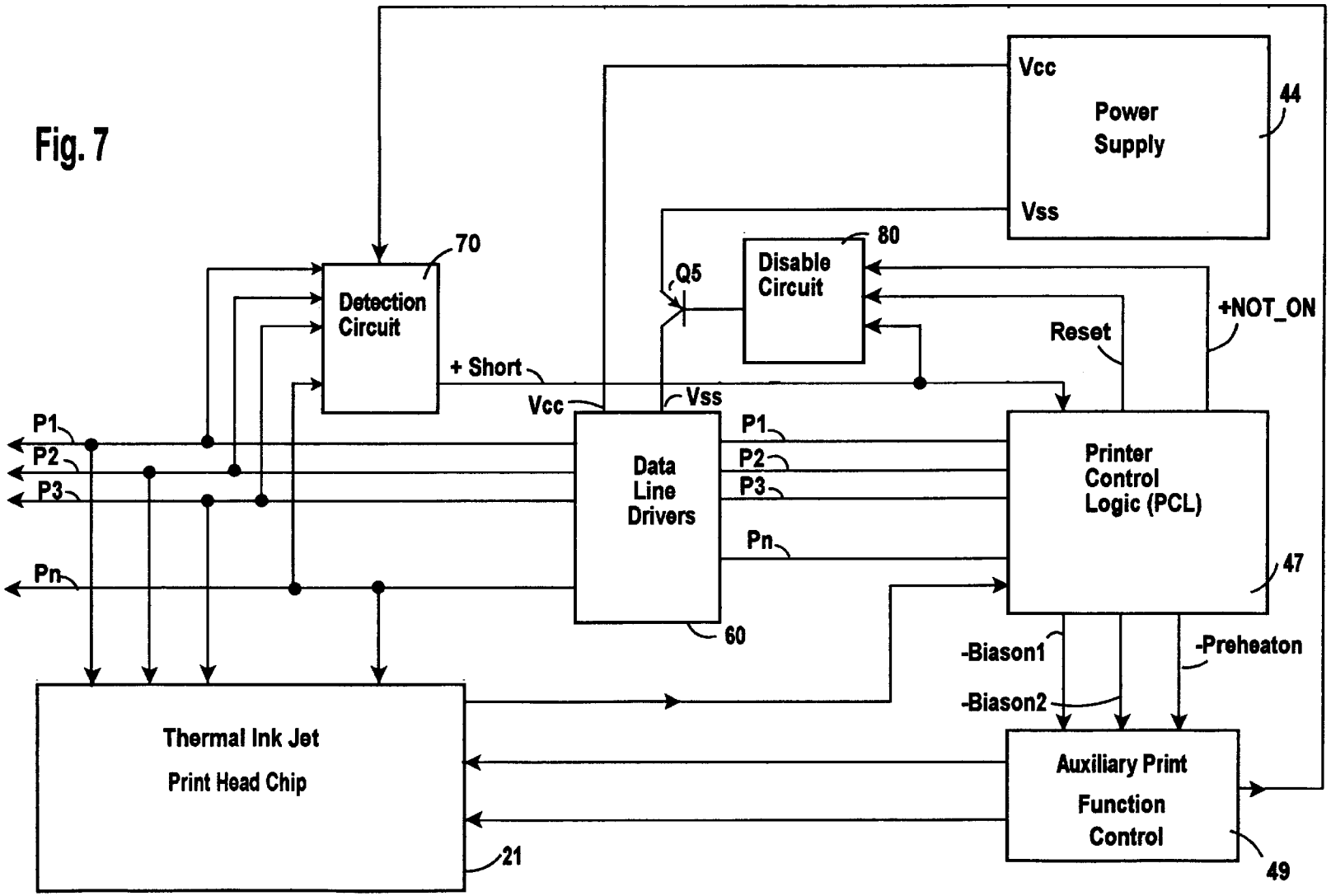
FIG. 7 is a block diagram of the circuitry shown in FIG. 5, to protect against data line to ground short circuits.

The carrier 22 and the printhead 28 are connected electrically by a flexible printed circuit cable 42 for supplying power from the power supply 44 and control and data signals from the machine electronics 46 which includes the printer control logic (PCL) 47 (see FIG. 7). As illustrated in FIG. 1C, and as will be more fully described hereinafter, the nozzle plate portion 30 (and its underlying but bonded to chip 21) is bonded to the bottle 32. The chip I/O, including control signals and power, is applied through TAB circuit 31 and spaced apart integrated lands 33 therein (see FIGS. 1D and 3) for making connection to the chip 21. In the illustrated instance, the tape 31 extends adjacent the bottle 32 with terminal pads (not shown) therein for mating engagement with terminal protrusions or projections 43 on the flexible printed circuit cable 42 connected to the carrier 22. Thus upon insertion of the printhead 28 into the carrier 22, electrical mating engagement occurs between the TAB circuit 31 and terminal projections 43 of the flexible printed circuit cable 42.

In the above structure, when printing occurs, simultaneously with a movement of the carrier 22 in the direction of the arrow 24 in FIG. 1A, the electro-thermal converting element (resistor), associated with each nozzle 30*a*, is driven selectively in accordance with recording data so that ink droplets eject from the nozzles 30*a* in the nozzle plate 30 and impinge upon the surface of the print receiving media 12, the ink drops forming the recording information on the print receiving media 12.

Figure 2:
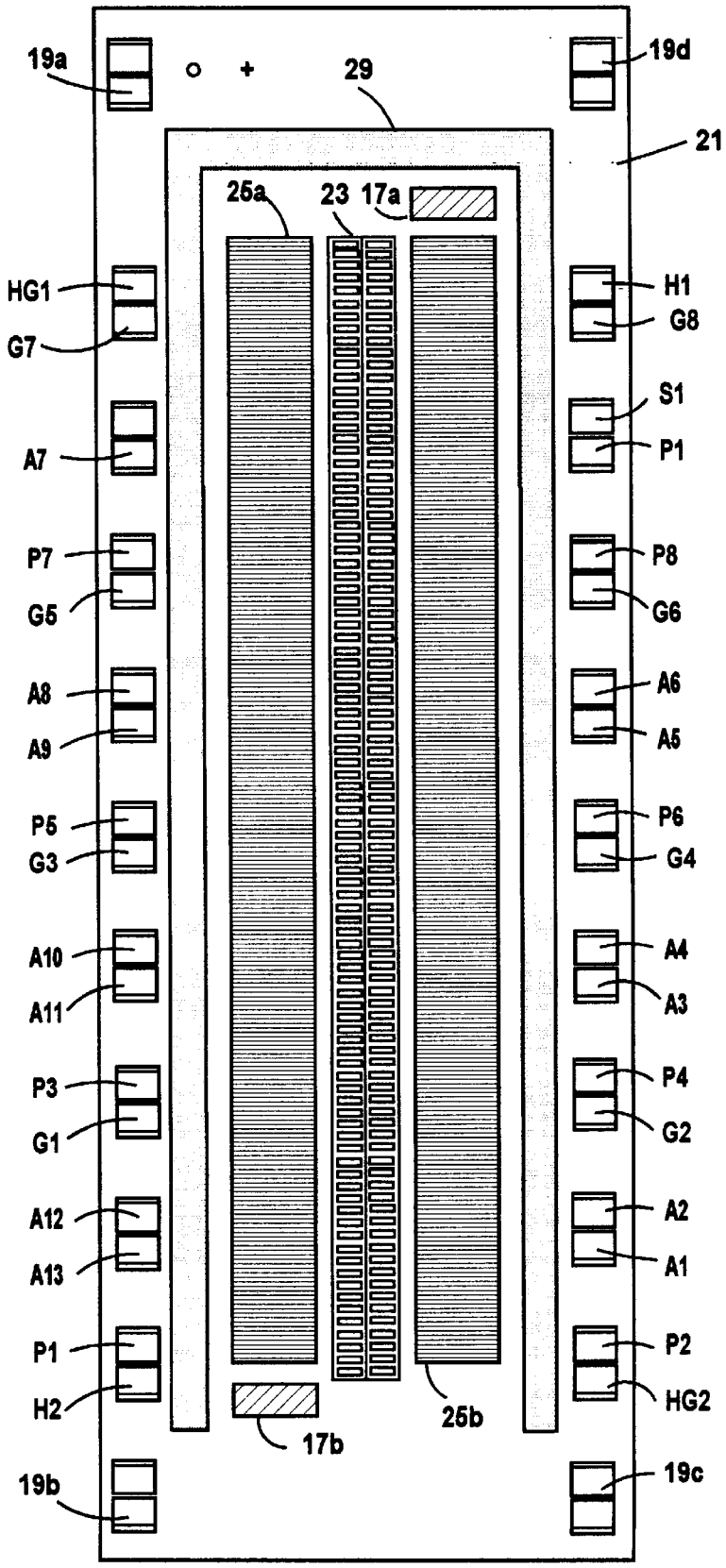
FIG. 2 is an enlarged schematic view in plan of a typical integrated circuit (IC) chip, (not to scale) illustrating, inter alia, driver, heater resistors and pad connections for chip input/output (I/O)

FIG. 2 is a greatly enlarged, schematic representation of the Integrated Circuit (IC) heater chip 21 which forms part of the printhead 28 of the ink jet printer 10. In real measurement terms, the chip is approximately ⅓" (~8.5 mm) by ⅙" (~2.8 mm). The chip is one of many cut from, in a conventional manner, a silicon wafer which has been coated with photo resist, photo lithographically exposed through a mask, subjected to an etch bath and doped by processes well known in the art of semiconductor manufacturing. The process is repeated through several layers, including metalization for I/O pads, usually making multiple integrated circuit chips on a single wafer, which is then cut into individual chips. As shown, the central portion of the chip includes longitudinally extending arrays of resistors 23, there being one resistor for each nozzle 30*a*. Each resistor is connected to an active circuit comprising, in the present instance, a field effect transistor (FET), arranged, as shown, on opposite sides of the arrays of resistors 23. In the drawing, these are represented by two columns 25*a*, 25*b*. As will be explained later with reference to FIG. 5, the active circuits are arranged, e.g., in a matrix of data lines (P1–P8) and address lines (A1–A13). I/O pads, along the periphery of the chip 21, are labeled with address and data lines which connect to an address and data line bus 29. Other of the pads, forming I/O connections are labeled as follows:

G1–G8 are ground pads.

H1–H2 are pre-heat resistor connection pads.

HG1–HG2 are pre-heat resistor ground pads.

S1 is the print head i.d. pad.

Pads 19*a*–9*d* are test pad pairs for the chip, and the "+" and "o" markings are for alignment purposes. The pre-heat resistors 17*a* and 17*b* are useful for preheating the chip upon startup, long delays between print commands or even for pre-warming the chip and ink while and during the printing of the first few lines on a printed page. A print head identification shift register (S/R) 51 (FIG. 5) is also provided on each chip 21, the shift register containing parametric information for the print head which is employed by the printer control logic for print control.

Figure 3:
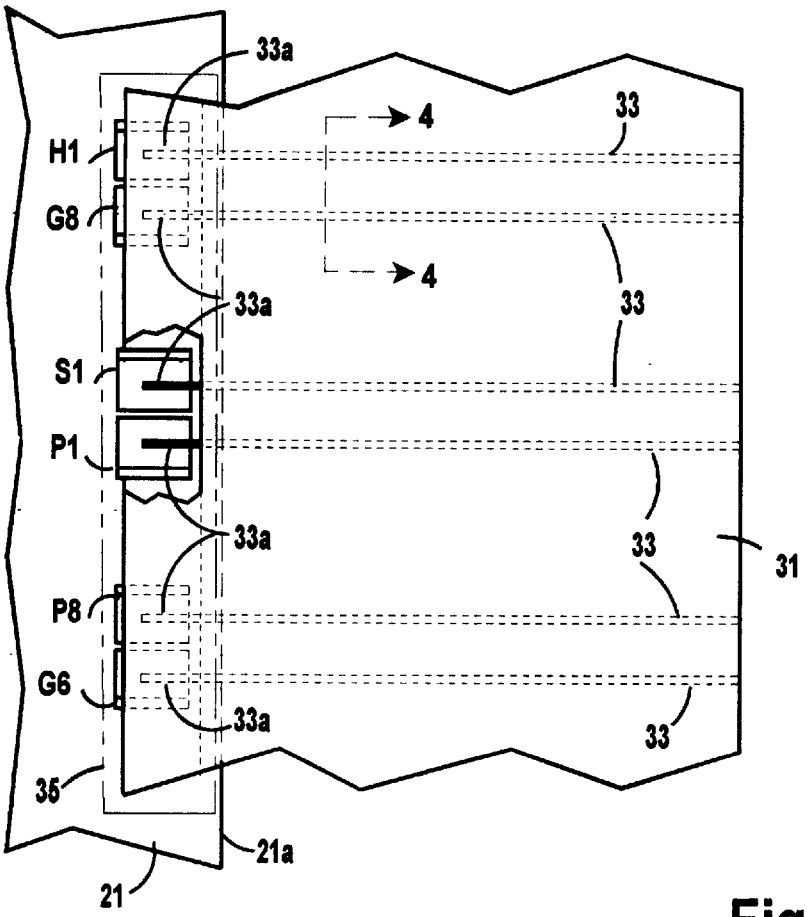
FIG. 3 is a fragmentary, enlarged, view in plan of TAB circuitry connecting to the chip of FIG. 2.

Referring now to FIG. 3, FIG. 3 is a fragmentary, enlarged, view in plan of TAB circuitry or tape 31 connected to the chip 21 of FIG. 2. As shown, the extended beam ends 33*a* of the lands 33 are bonded to individual pads of the pad pairs of the chip 21, in the illustrated instance pads H1, G8; S1, P1; and P8, G6. The area 35 (bounded by phantom lines) along the chip 21 edge 21*a* is conventionally covered by an encapsulant such as potting compound, to inhibit ink bridging (and therefore shorts) between the beams 33*a* and the chip I/O pads.

Figure 4:
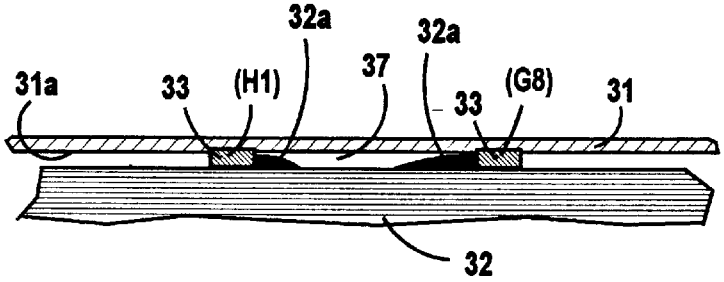
FIG. 4 is an enlarged, fragmentary sectional view taken along lines 4—4 of FIG. 3, and illustrating the possible location of inadvertent ink causing the start of EIIBU.

To further inhibit any ink shorts elsewhere on the tape 31, the underside 31*a* of the tape 31 is coated. However, the coating itself is occasionally subject to flaws or holes such as the void 37 shown greatly enlarged in the fragmentary cross sectional view of FIG. 4. Because of occasional leakage from the printhead and ink "puddling" from printing, ink may creep under the tab circuit and make its way to void 37. Due to the ionic nature of the ink 32*a*, it will tend to be attracted to the circuit lands if a differential voltage exists for an extended length of time between the pads. The situation in FIG. 4 is ideal for exacerbating that problem because of the difference in potential that would exist, between adjacent pads, if for example R1 in FIG. 5 were connected directly to Vcc. In the illustrated instance, Vcc is a DC voltage which is applied through R1 to a preheat resistor such as the resistor 17*a* shown in FIGS. 2 and 5, while G8 is a ground.

Therefore, and in accordance with the invention, power is externally gated to the resistor R1 through pads H1 and H2 (for example) only when it is desired to provide DC bias to the preheat resistors 17*a*, 17*b*. In other words, gating of power from the power supply to the desired function, in the illustrated instance "short circuit detect", is actuated externally of the chip 21 rather than having the chip always powered and gating occur internally of the chip while maintaining a voltage potential difference on adjacent pads of the chip. The application of power to various functions on the chip, where a voltage difference may occur on adjacent pads (and thus lands 33 of the flexible bonding tape), is preferably, and in accordance with the invention, non continuous, the control being, as will be shown hereinafter, by the Printer Control Logic 47 (FIG. 7) gating power to the chip 21. Preferably, the application of power to the chip pads is effected only for a duration necessary to accomplish the function. While this will not prevent EIIBU from ultimately occurring, it will serve to increase the time to failure (because of shorts due to EIIBU), and usually, due to ink usage, cause the printhead to be replaced or refurbished and more ink supplied, before bridging due to EIIBU can occur.

Figure 5:
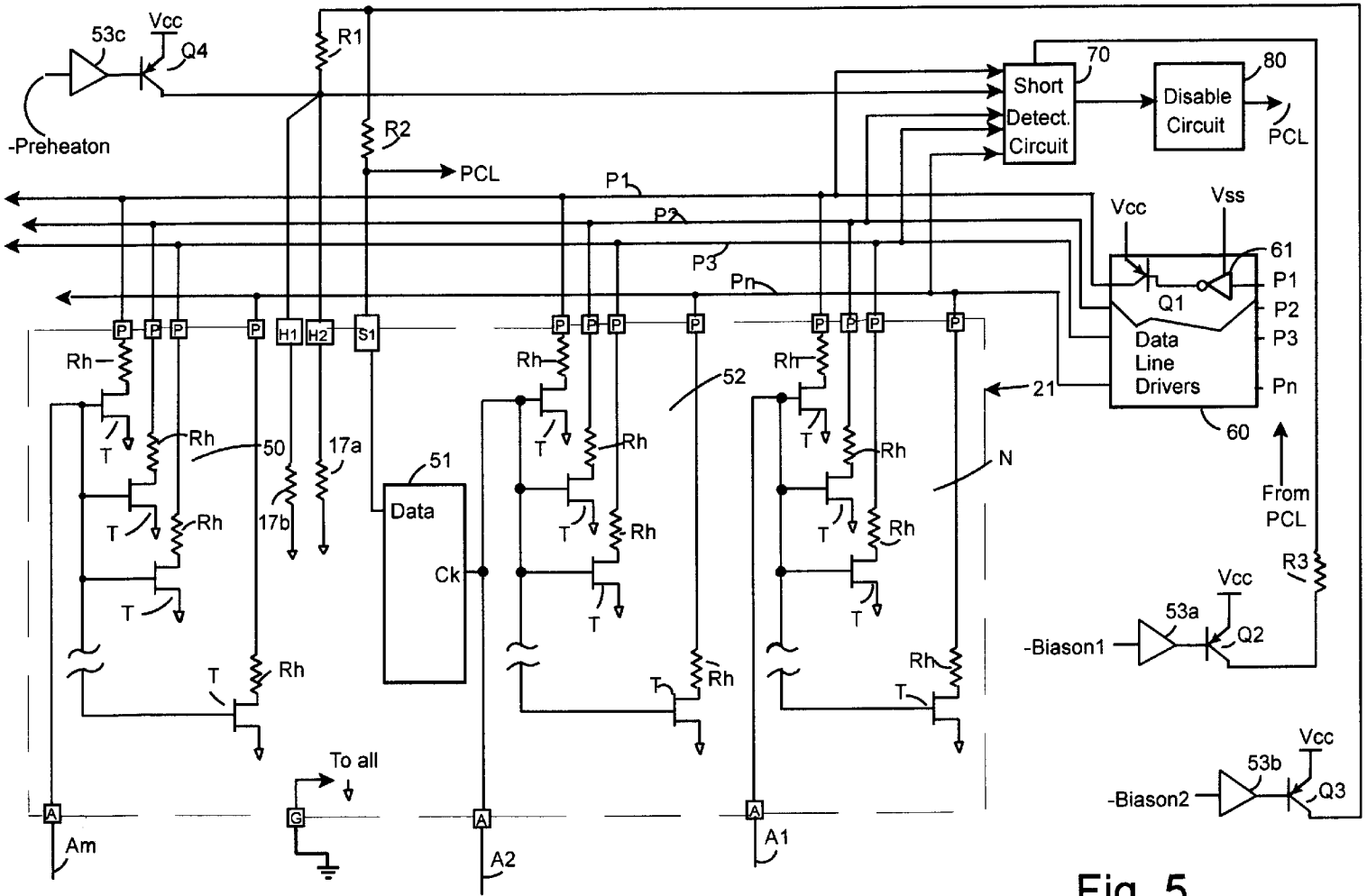
FIG. 5 is a schematic diagram of a typical "row-column" or matrix driver scheme for a thermal ink jet printhead of a thermal ink jet printer, such as illustrated in FIG. 1, and showing the "off chip" circuits for inhibiting EIIBU.

FIG. 5 shows a typical "row-column" or "matrix" driver scheme for the thermal ink jet printhead 28. The nozzles, or ink ejecting outlets 30*a* in the nozzle plate 30, are normally arranged in groups or banks in columns and/or rows. For example, in FIG. 5, arranged in the integrated circuit 21 on the printhead 28, are a plurality of groups 50, 52 . . . N of nozzle heater drivers, in the present instance field effect transistors "T". While only three such banks arc shown, by way of example only, there may be 12 or more banks or groups of nozzles. Each of the FET transistors "T" of each of the groups is associated with a nozzle or ink ejecting outlet in the nozzle plate 30, and each of the FET's includes a heater resistor Rh in the drain of the FET. Each of the sources of the FET transistors T are connected to ground and a ground connection at the "G" pads (only one being shown in FIG. 5) connects all of the grounds to a machine ground for the ink jet printer 10. The high end of each of the heater resistor's Rh of a bank or group is connected to a separate data line input or "P" pad on the chip 21, while each of the gates of a bank is connected to a single "A" pad to provide a single address line input for each of the banks 50, 52 . . . N.

Figure 6:
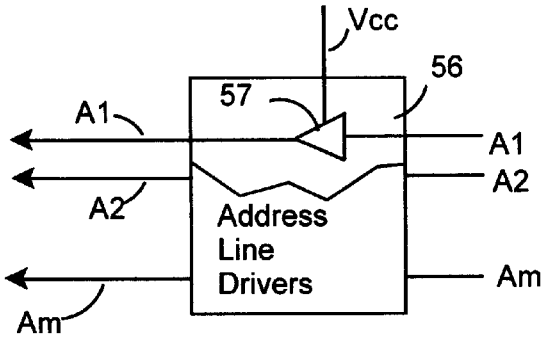
FIG. 6 is a schematic diagram illustrating the address line drivers employed in connection with the associated schematic of FIG. 5.

Referring now to FIG. 6, when an "A" address line A1, A2 . . . Am is driven to a HIGH state, all of the printhead heater resistors Rh of a bank are enabled to be driven by turning ON the associated FET's "T" on the printhead 28. For example, one of a group of address line drivers 56 (each of which may comprise a buffer-amplifier 57), may receive a high input along the address line Am. The high signal is fed through the buffer-amplifier 57 and applied to the gates of each of the FET's "T" in bank 50. An individual heater resistor Rh is turned ON if its particular "P" (data) line is driven active. Current is then conducted through the heater resistor Rh locally heating the ink in the nozzle to thereby increase the volume therein and force a drop of ink to be ejected from that nozzle 30*a*.

A group 60 of data or "P" line drivers is illustrated in FIG. 5. One of the data line (or "P" line) driver circuits, associated with data line P1, is shown in more detail. When a P driver line is to be activated, for example line P1, PNP transistor Q1 is turned ON by the application of a low signal to the base of the transistor Q1. This means that the signal applied to the invertor-amplifier 61 must be a high signal to force its associated data line high. When transistor Q1 is turned on, the power supply voltage, Vcc, is applied to the P1 data line. Power supply voltage Vss is a low power level pre-drive voltage used to turn ON Q1. Often, but not necessarily, Vss is the same voltage as Vcc but operates at a much lower current level and is brought into the driver on a separate line from the power supply 44. Note that application of data to the P1 line applies the Vcc voltage to the top of all heater resistors Rh which are connected thereto, one in each bank of FET's "T". If, for example, only address line Am is high, then only the first FET in bank 50 will be in a conductive mode, heating the ink in its associated nozzle 30*a*, and thereby causing an ink drop ejection from the nozzle. Note also that voltage Vcc is gated to particular data pads ("P") only when required, and then may be removed by gating the power supply off. In this manner voltage differentials between adjacent pads, with regard to time or duration, may be minimized.

Ground is present on the printhead chip itself because the addressed FET's must have their sources connected to ground for operation. This presents the possibility of a short circuit of moderate to low impedance between ground and any driven line on the printhead, i.e. data lines ("P") or address lines ("A"). Short circuits can be caused by many things: manufacture error; stress on a weak printhead etc. However, ink in the TAB circuit area, as described relative to FIG. 4, can cause shorting of the data lines destroying a data line driver. The present invention, by minimizing "on" time of voltage on the chip pads where adjacent pads are subject to large voltage differentials, inhibits the EIIBU which may occur due to ink contamination in flaws in the flexible tape circuitry or other connecting cable such as cable 42, and further reduces the possibility of this kind of short occurring.

In accordance with the invention, instances of power supply energization of the chip, where adjacent pads have a voltage differential and EIIBU may occur on the TAB or flexible printed circuits due to the differential and ink contamination, (e.g. FIG. 4), are minimized by gating of the power supply to the pads only for durations essential to proper working by energization of the particular function.

To this end, and referring now to FIG. 7, the printing functions for the printer 10 is conventionally under control of the printer control logic (PCL) 47 which is part of the machine electronics 46 (FIG. 1). Part of the printer control logic 47 is the auxiliary printer function control 49 which handles the important, but non-essential parts of the printing operation. For example, a data line detection circuit 70 which (in a manner to be described hereinafter) in the event of the detection of a short circuit, energizes a disable circuit 80 for inhibiting the operation of the data line drivers 60, which in turn inhibits the print chip 21 heater control which isolates the application of voltage to the heater pads H1 and H2 on the chip 21. In addition, printer control logic 47 supplies voltage only for the duration essential for chip pre-heat. Print head identification data located in a shift register or ROM on the chip, upon demand, supplies print head parametric data back to the PCL 47. As shown in FIG. 5, data contained in the shift register 51 is clocked out of the shift register through its data output and then back to PCL 47 upon application of an appropriate signal from the A2 address line (and of course the application of voltage Vcc across the high resistance resistor R2).

Figure 8:
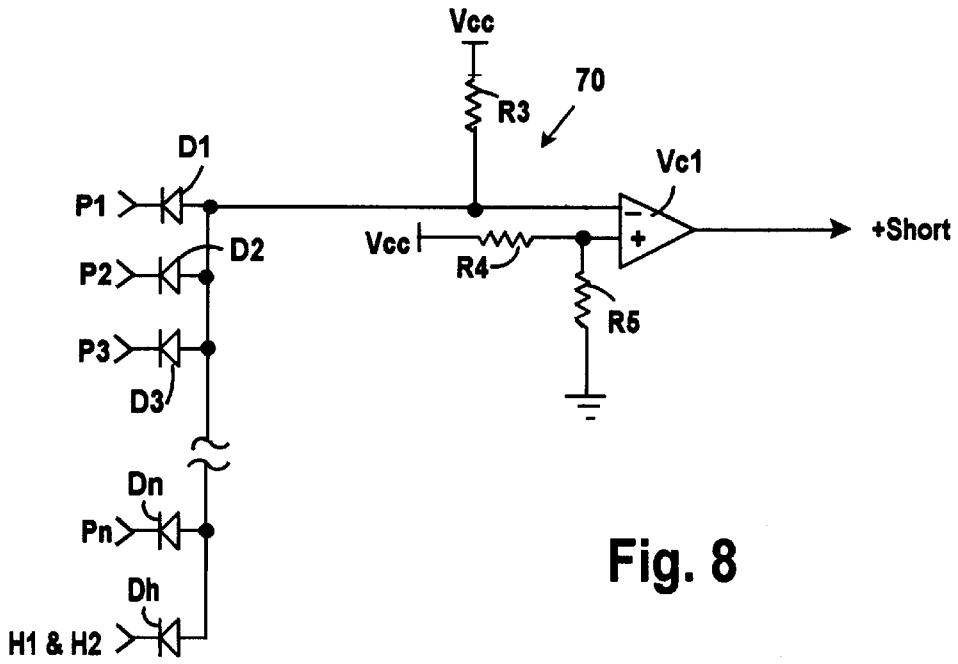
FIG. 8 is a schematic diagram of a short circuit detection circuit which may be employed in conjunction with the present invention.
Figure 9:
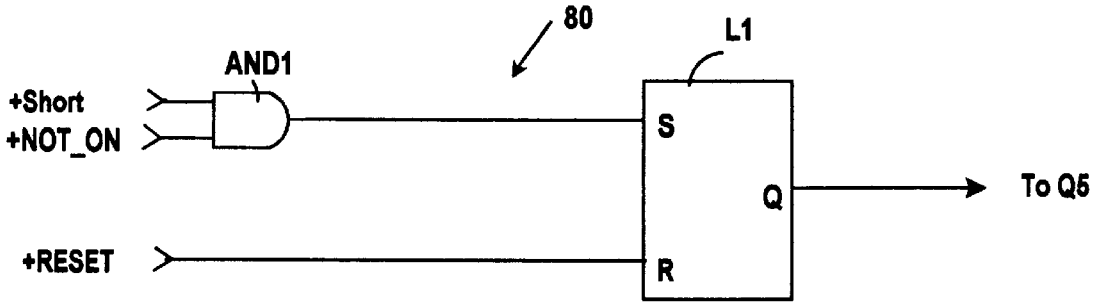
FIG. 9 is a schematic diagram of an embodiment of a disable circuit which may be employed in conjunction with the present invention.

The contents of the auxiliary printer function control 49 are best described with respect to FIGS. 5, 8 and 9. Referring first to FIG. 5, pull-up resistors R1, R2, and R3 provide positive drive and bias for the print head ID shift register 51 through Pad S1, and short detection circuit 70. If the potential for EIIBU did not exist, these resistors could be connected directly to the DC voltage Vcc. In accordance with the present invention, the pull-up resistors only receive their bias when it is necessary to perform the operation intended. For instance when checking for short circuits on the data (P) lines to ground, the control signal −BIASON1 is forced to a logic LOW state which, through buffer amplifier 53*a* turns ON transistor, Q2, applying bias voltage Vcc to pull-up resistor R3. If the print head ID or short circuit detect for the substrate heater driver is to be performed, control signal −BIASON2 is forced LOW and transistor Q3 is turned ON through buffer amplifier 53*b*, to apply voltage Vcc from the power supply 44 to pull-up resistors R1 and R2. When −BIASON1 and −BIASON2 are in a HIGH logical state, bias is removed from the pulls so that EIIBU cannot occur. It should be noted that the values of R1 and R2 are high and therefore a separate power or voltage supply is made for supplying heater current through chip pre-heaters 17*a*, 17*b* via pads H1 and H2 respectively. As shown, transistor Q4 is supplied with a LOW signal −PREHEAT ON through a buffer amplifier 53*c* to turn on transistor Q4. This supplies voltage Vcc to the collector of Q4 and thus to the heaters 17*a*, 17*b*. Once again, bringing the −PREHEAT ON signal HIGH will cause the current through the heater resistors to cease.

Referring now to FIGS. 7 and 8, detection circuit 70 is schematically shown to detect P line (data) to G (ground) short circuits and pre-heater to ground short circuits, and in conjunction with disable circuit 80 (FIG. 9) and printer control logic (PCL) 47, to stop machine operation until the defect is corrected.

In brief, the operation is as follows: when the short circuit detection circuit 70 detects a P line to ground short, the short circuit detection circuit 70 brings a +SHORT line output to a logical HIGH level which may be fed to the printer control logic 47, where: (1) The control logic 47 may inhibit operation of the printhead by, for example, preventing further data signals from being sent to the data line drivers 60 to thereby prevent P line driver damage, or (2) the +SHORT output to a logical HIGH level which is fed to a disable circuit 80. The disable circuit 80, in a manner which will be described later with reference to FIG. 9, turns OFF transistor Q5 which prevents the firing of the P lines by disabling the power supply voltage Vss to the data line drivers which in turn prevents damage to the line drivers.

Referring now to FIG. 8, an embodiment of a short circuit detection circuit 70 is shown connected to resistor R3. One skilled in the art will recognize that when transistor Q2 of FIG. 5 is gated ON, the voltage Vcc is applied to resistor R3 as shown in FIG. 8. As shown in FIG. 8, short circuit detection circuit 70 may be employed including a plurality of diodes D1, D2, D3, . . . Dn, Dh, each diode correspondingly connected to a data line "P", with the diode Dh being connected to the top of pre-heat resistors 17*a* and 17*b*. The diodes are arranged in a common anode scheme and pulled up to voltage Vcc through resistor R3 and transistor Q2. Resistors R4 and R5 are arranged as a voltage divider and provide a DC reference voltage to the positive input of a voltage comparator Vc1. If a short circuit to ground is present on any one of the P lines or in the pre-heat resistors, this will pull the voltage on the negative input of Vc1 below the reference voltage present on the positive input of Vc1. A voltage below the reference voltage at the negative input will drive the inverted output of Vc1 to a logical HIGH state on the +SHORT line, signaling a short circuit is present. If no short circuit is present, the negative input of Vc1 will be pulled up to Vcc by R1. This will force the output of Vc1 to a logical LOW state on the +SHORT line, signaling that it is permissible to print.

It should be understood that the resistance value of R3 is placed high enough so that when the addressed FET's in the printhead are turned ON, the current that flows in R3 is low enough so not to effect normal heater resistor operation when printing.

There are a number of ways in which the control logic 47 may be implemented. For example, the control logic 47 could be either a microprocessor implementation under software or firmware control, or simply combinatorial hardware logic. It should be recognized the high signal on the +SHORT line could be directly input into the control logic 47 and act directly upon the data stream to prevent the input to the drivers with simple NOT-AND combinatorial software or hardware logic. Moreover, the +SHORT signal could be directly employed with a simple latch and hold to prevent the enablement directly of address signals.

The operation of the drivers 60 themselves may be inhibited to prevent damage thereto. To this end, FIG. 9 shows an embodiment of a disable circuit. The signal on the +SHORT line is from the short circuit detection circuit. The +NOT ON signal (no print or no data signal) is generated by the printer control logic 47. Referring to FIG. 5, when an "A" address line is activated this will enable all the FET's for that address. If any P line is not being fired (turned ON to voltage level Vcc) at that instant, those P lines not fired will be pulled down to ground by the turned ON address FETs. This will show up as a +SHORT on the output of Vc1 for that instant of time. Since the printer control logic 47 knows when it is firing nozzles (i.e. when a particular data line is energized) it can ignore +SHORT indications during nozzle firing instants of time.

Alternatively, the printer control logic 47 can generate a low signal on the +NOT_ON line input, which can be used to mask out the +SHORT indication to the disable circuit during the instants of nozzle fires. However, as set forth above, the short circuit detection circuit 70 brings the +SHORT output to a logical HIGH level when a short is detected, which signal is fed to the disable circuit 80. The disable circuit 80, as shown in FIG. 9 and as discussed above, turns OFF transistor Q5, which prevents the firing of the P lines which prevents damage to the P line driver.

At power ON of the printer, a +RESET signal (FIG. 9) resets latch L1's Q output to a LOW logic state turning ON transistor Q5 (see FIG. 3), enabling the P line or data line drivers to operate. If the +SHORT is in a HIGH state, indicating a short circuit, and +NOT ON is also HIGH, indicating a nozzle is not being fired at that instant in time, then the output of AND1 is HIGH, setting L1's Q output to a HIGH logic state. This turns OFF Q5, inhibiting the application of the power supply voltage Vss to the invertor amplifier 61 (FIG. 5), disabling the P line driver so that no damage can occur.

Thus the present invention inhibits the electrically induced ink build-up between metalizations on the TAB circuit connected to pads on the heater chip IC and on the flexible printed circuit cable, where electrically induced ink build-up can occur when there is some leakage of ink into the circuit trace area and the insulation on the TAB and/or flexible printed circuit is incomplete. This is accomplished by limiting the duration of the application of differential voltages to adjacent line pairs.

Although the invention has been described with a certain degree of particularity, it should be recognized that elements thereof may be altered by person(s) skilled in the art without departing from the spirit and scope of the invention as hereinafter set forth in the following claims.

What is claimed is:

1. A thermal ink jet printer, comprising:

printer control logic for producing control signals corresponding to print functions, wherein said print functions include ejecting a drop of ink;

a print head disposed separately from said printer control logic for performing the print functions in response to and corresponding to the control signals, said print head further comprising:

(a) an integrated circuit chip disposed in said print head;

(b) active circuitry disposed on said integrated circuit chip;

(c) heater elements disposed on said integrated circuit chip and electrically connected to said active circuitry for heating said ink;

(d) a nozzle plate disposed in the print head; and (e) a plurality of ink ejecting nozzles in the nozzle plate, said nozzles being positioned such that a heater element underlies each nozzle so that the ink ejects from a nozzle when said heater element underlying said nozzle receives voltage;

a power supply disposed separately from said print head for providing the voltage to said integrated circuit chip; and gating means disposed separately from said print head for receiving the control signals and being responsive to the control signals for gating the voltage from the power supply to said integrated circuit chip only for a duration necessary for performance of said print function corresponding to the control signals received by said gating means so that electrically induced ink build up is inhibited externally of said integrated circuit chip, and wherein said duration includes an amount of time required to eject a drop of ink.

2. A thermal ink jet printer in accordance with claim 1, further comprising:

a plurality of pads for receiving the voltage from said gating means, said pads being disposed externally of said integrated circuit chip and including a plurality of pairs of closely spaced adjacent pads, said plurality of pads being electrically connected to said active circuitry and wherein at least one of the pads has voltage gated to it in response to said control signals; and said gating means being operable to gate the voltage to one pad of a pair only for the duration necessary for performance of said print function when an equal voltage is not being applied to the other pad of the pair during performance of said print function.

3. A thermal ink jet printer in accordance with claim 2, wherein the control signals include auxiliary control signals corresponding to auxiliary print functions, said print functions including said auxiliary print functions which include printer monitoring functions that are not essential for printing but allow the printer to perform reliably and with higher quality; and wherein said ink jet printer further comprises:

auxiliary print function means for performing the auxiliary print functions, said auxiliary print function means being disposed in said integrated circuit chip and electrically connected to said pads; and wherein said gating means for gating the voltage from said power supply to said pads gates the voltage to the pads that are electrically connected to said auxiliary print function means in response to said auxiliary control signals.

4. A thermal ink jet printer in accordance with claim 3, wherein said auxiliary print function means comprises:

a chip pre-heater for heating said integrated circuit chip; and wherein the auxiliary print functions include heating said integrated circuit chip.

5. A thermal ink jet printer in accordance with claim 3, wherein said auxiliary print function means comprises:

a single address line;

sending means disposed within said integrated circuit chip and connected to said pads for storing print head identification data and for transferring the print head identification data from said print head to said printer control logic through the single address line; and wherein said auxiliary print functions include transferring the print head identification data from said print head to printer control logic.

6. A thermal ink jet printer in accordance with claim 3, further comprising:

fault detection circuits for detecting faults, including short circuits, on said print head, said fault detection circuits being electrically connected to said gating means, said printer control logic, and said pads.

7. A thermal ink jet printer in accordance with claim 1, further comprising:

a carrier disposed in said printer for carrying said print head;

reciprocating means for moving said carrier adjacent to print receiving media, said reciprocating means being mounted to said printer and said print head, and electrically connected to said printer control logic; and an ink supply for supplying the ink to said nozzles and said heater elements.

8. A method of inhibiting electrically induced ink build-up (EIIBU) between adjacent pairs of lands of flexible printed circuit cable in a thermal ink jet printer, wherein said cable electrically interconnects a print head with an integrated circuit chip disposed therein to a printer control logic and a power supply disposed separately from said print head, said method comprising:

gating voltage from said power supply to said integrated circuit chip on said print head in response to said printer control logic sending a control signal corresponding to a print function that includes ejecting a drop of ink, said control signal being sent to a gating means that gates power from said power supply to said integrated circuit chip in response to said control signal; and maintaining application of the voltage from said power supply to said integrated circuit chip on said print head by continuing to gate the voltage only for a duration necessary for performance of the print function corresponding to the control signal that is sent to said power supply by said printer control logic, and wherein said duration includes an amount of time necessary to eject a drop of ink.

9. The method of claim 8, further comprising gating the voltage to one land of a pair of lands only for a duration necessary to perform the print function when an equal voltage is not being applied to the other land of the pair during performance of said print function.

* * * * *